US009756935B2

(12) United States Patent
DeMichael et al.

(10) Patent No.: US 9,756,935 B2
(45) Date of Patent: Sep. 12, 2017

(54) CONVERTIBLE, INTEGRAL, DINING TABLE, COFFEE TABLE, SERVING TABLE, DESK, BED, BENCH AND BEACH LOUNGER UTILIZING A UNIQUE HINGING SYSTEM

(71) Applicants: David DeMichael, Hanover (JM); Julio A Martinez, Wauconda, IL (US)

(72) Inventors: David DeMichael, Hanover (JM); Julio A Martinez, Wauconda, IL (US)

( * ) Notice: Subject to any disclaimer, the term of this patent is extended or adjusted under 35 U.S.C. 154(b) by 0 days.

(21) Appl. No.: 15/161,286

(22) Filed: May 23, 2016

(65) Prior Publication Data

US 2016/0338491 A1 Nov. 24, 2016

Related U.S. Application Data

(60) Provisional application No. 62/166,010, filed on May 24, 2015.

(51) Int. Cl.

| | |
|---|---|
| ***A47C 4/00*** | (2006.01) |
| ***A47C 4/12*** | (2006.01) |
| ***A47B 85/04*** | (2006.01) |
| ***A47C 13/00*** | (2006.01) |
| ***A47C 1/14*** | (2006.01) |
| ***A47B 9/20*** | (2006.01) |
| ***A47C 11/00*** | (2006.01) |
| ***A47B 85/06*** | (2006.01) |
| ***A47B 13/08*** | (2006.01) |
| *A47B 31/00* | (2006.01) |

(52) U.S. Cl.

CPC ..... *A47B 9/20* (2013.01); *A47B 13/081* (2013.01); *A47B 13/088* (2013.01); *A47B 85/04* (2013.01); *A47B 85/06* (2013.01); *A47C 1/143* (2013.01); *A47C 11/00* (2013.01); *A47C 13/00* (2013.01); *A47B 2031/004* (2013.01)

(58) Field of Classification Search

CPC ..... A47C 11/00; A47C 1/143; A47C 13/00; A47B 85/06; A47B 13/081; A47B 13/088; A47B 85/04; A47B 9/20

USPC .... 297/31, 118, 119, 129, 357, 900, 344.18, 297/124

See application file for complete search history.

(56) References Cited

U.S. PATENT DOCUMENTS

| | | | | | |
|---|---|---|---|---|---|
| 33,192 | A * | 9/1861 | Gurley et al. | A47C 17/165 | 297/118 X |
| 304,282 | A * | 8/1884 | Skau | A61G 7/015 | 297/366 |
| 325,326 | A * | 9/1885 | Ditmars | A47C 17/207 | 297/118 X |
| 377,806 | A * | 2/1888 | Graves | A47C 13/00 | 297/119 |
| 389,911 | A * | 9/1888 | Tribbey | A47C 17/60 | 297/118 |
| 661,232 | A * | 11/1900 | Shipley | A61G 7/015 | 5/613 |
| 802,221 | A * | 10/1905 | Kuhnen et al. | B63C 9/30 | 297/118 |
| 1,049,394 | A * | 1/1913 | Predock | B60N 2/305 | 297/118 |

(Continued)

*Primary Examiner* — Rodney B White

(57) ABSTRACT

A convertible, integral, dining table, coffee table, serving table, desk, bed, bench and beach or chaise lounge, consisting of 4 flat deck sections of which one is fixed and 3 are independently inclinable. The unit is supported by 4 pivotable legs, each with height adjustability. The inclination of the deck sections are made possible by a unique hinging system.

10 Claims, 9 Drawing Sheets

(56) References Cited

U.S. PATENT DOCUMENTS 1,888,325 A * 11/1932 McCarroll ..... A47C 13/00 297/118
1,896,455 A * 2/1933 McCulloh ..... A47C 4/16 297/1
2,216,317 A * 10/1940 Karish ..... A47C 17/163 297/19
D154,031 S * 6/1949 Eisendrath ..... D6/361
2,845,112 A * 7/1958 Borenstein ..... A47C 17/12 297/118
D193,322 S * 7/1962 Thomas ..... D24/183
3,055,704 A * 9/1962 Darwin ..... A47B 85/00 108/129
3,379,472 A * 4/1968 Hilfiker ..... A47C 7/024 108/115
3,386,110 A * 6/1968 Vanhentenrijk ..... A47B 85/00 297/118
D226,061 S * 1/1973 Kellman ..... D6/361
D233,090 S * 10/1974 Laylon ..... D6/361
3,873,114 A * 3/1975 Brown ..... B62B 3/02 280/30
4,221,428 A * 9/1980 Bowman ..... A47C 3/029 297/110
4,282,613 A * 8/1981 Violante ..... A61G 7/02 297/118
4,615,559 A * 10/1986 Blondeau ..... A47B 3/14 297/124
4,801,175 A * 1/1989 Albanese ..... A47B 85/04 297/124
5,398,990 A * 3/1995 Watts ..... A47B 85/00 297/127
5,494,333 A * 2/1996 Wilson ..... A47C 7/002 297/344.18 X
5,516,197 A * 5/1996 Condos ..... A47C 3/38 297/344.18
5,529,270 A * 6/1996 Liu ..... A47C 17/68 248/166
5,882,083 A * 3/1999 Robinson ..... A47C 1/0342 297/118
6,056,353 A * 5/2000 Meara ..... A61G 5/08 297/344.18
6,367,873 B1 * 4/2002 Dorner ..... A47C 17/161 297/110
6,702,384 B1 * 3/2004 Brown ..... A47C 3/38 297/344.18 X
6,860,567 B1 * 3/2005 Bauer ..... A47C 1/143 297/900 X
6,893,386 B2 * 5/2005 Charoenchit ..... A61H 1/0214 297/118 X
6,976,732 B2 * 12/2005 Thomas ..... A47B 85/04 297/1
7,207,622 B2 * 4/2007 Cohan ..... A47C 1/143 297/31 X
7,429,077 B2 * 9/2008 Yul ..... A47B 3/14 108/11
7,549,702 B2 * 6/2009 Meyers ..... A47K 3/122 297/344.18 X
7,631,940 B1 * 12/2009 Jager ..... A47C 1/026 297/344.18 X
8,002,349 B1 * 8/2011 Pizzuto ..... A47C 1/143 297/184.11
8,152,233 B2 * 4/2012 Wechter ..... A47K 3/122 297/119 X
8,276,984 B1 * 10/2012 Jamison ..... A47C 17/14 297/119
8,474,916 B2 * 7/2013 Smith ..... A47C 3/18 297/344.18 X
8,500,202 B2 * 8/2013 Nielsen ..... A47C 20/041 297/316
8,662,584 B1 * 3/2014 Townsend ..... A47C 31/11 297/31 X
8,677,524 B2 * 3/2014 Kume ..... A61G 5/04 5/613
8,794,699 B1 * 8/2014 Rudolfo ..... A47C 4/20 297/118
8,991,913 B2 * 3/2015 Chen ..... A47C 4/20 297/16.1
8,997,274 B2 * 4/2015 Phillips ..... A47C 1/0242 5/37.1
9,039,077 B1 * 5/2015 Santamaria ..... A47C 7/72 297/31
9,414,980 B2 * 8/2016 Kume ..... A61G 5/1067
2005/0121949 A1 * 6/2005 Williams ..... A47C 17/04 297/118
2006/0170267 A1 * 8/2006 Ward ..... A47C 9/10 297/344.18
2007/0169266 A1 * 7/2007 Kim ..... A47C 20/041 5/607
2009/0127892 A1 * 5/2009 Chen ..... A47C 13/00 297/118
2010/0001565 A1 * 1/2010 Gray ..... A47C 31/11 297/229
2010/0314914 A1 * 12/2010 Mazzola ..... A47C 3/34 297/344.18 X
2012/0153687 A1 * 6/2012 Kume ..... A61G 5/1067 297/118
2014/0191541 A1 * 7/2014 Ohta ..... A61G 5/04 297/118

* cited by examiner

CONVERTIBLE, INTEGRAL, DINING TABLE, COFFEE TABLE, SERVING TABLE, DESK, BED, BENCH AND BEACH LOUNGER UTILIZING A UNIQUE HINGING SYSTEM

CROSS REFERENCE TO RELATED APPLICATIONS

This application claims the benefit of provisional patent application Ser. No. 62/166,010, filed on May 24, 2015, which is incorporated herein by reference.

BACKGROUND OF THE INVENTION

1. Field of the Invention

The present invention relates generally to convertible furniture and more specifically convertible furniture that functions as a counter surface, seating unit and bed in the form of a dining table, coffee table, bench seat and chaise lounge. This invention was developed as an attractive, well designed, universally appealing, multi-use piece of indoor/outdoor household furniture with commercial application to meet the changing daily requirements of everyday life with ease and flexibility never before enjoyed from a single piece of furniture.

BRIEF SUMMARY OF THE INVENTION

The present invention is a self-contained piece of indoor/outdoor furniture that can easily be converted to serve many different functions. The unit may serve as a bed, beach lounger, cocktail table, 6' bench, 4' or 2' bench with integral end table, massage table, dining table, work desk, serving counter and bar. The unit is easily adjustable to the different appropriate finished heights with an additional leg leveling feature.

The unit may be constructed from readily available construction lumber of various species such as pine, cedar, redwood, teak or any other commercially available lumber. Currently, the unit is being made from Jamaican Guango, Spanish elm, blue mahoe and rock cedar.

The unit generally comprises a frame, four flat desk sections and four leg assemblies. The unique aspect of the unit is the ability to multitask and serve as several distinct furniture pieces by way of independently tilting decks. The decks have the ability to tilt in two directions to become a seat back for a bench and in a 90-degree direction to become a backrest for a beach lounger. The decks ability to tilt in two directions is made possible by utilizing special hidden hinges. The hinge system was developed for this invention.

The four deck sections comprise two long sections and two short sections. The first section is a long section and is permanently fixed and so does not tilt. The second section is a long section and is capable of tilting. The third and fourth sections are both short sections and inclinable.

Splines positioned front-to-back along the sections of deck boards are added for additional stiffness and durability. A leg socket is anchored at each corner of the frame and holds the pivoting leg arm, leg extension and leveling screw. All members are screwed and glued. While the unit may be constructed from wood, it is anticipated the unit will also be manufactured using aluminum or metal extrusions as well as vinyl or composite resin material in mass production for all or part of the unit.

The design calls for a simple single pin pivot hardware to swing the legs in and out of position held in place by use of standard stainless steel pins. The legs are locked in place in the down position by use of a simple locking pin bored all the way through the leg socket.

When it is in the lowest position, the unit stands on four, square, socketed legs at each of the four corners. In this position, the unit may be used as a bed or coffee table. The third and fourth decks are hinged and can be lifted and set to any of three positions, locked in place by a pivoting support arm assembly that slides within a guided dual track and engages into any of three different slots or detents. Configured this way the unit functions as a beach lounger or chaise lounge.

Also, while set to this height, the second and third deck sections may be inclined and locked by the support arms forming a bench. It is also possible to raise only one deck to serve as a seat back and leave the other decks down to form a bench with side table. Each bench back is hinged using two stainless steel hidden hinges. Each bench back is supported using two folding, scissors type struts. Both bench back sections lock at the same angle to create the full length bench.

The leg assemblies have U-shaped, square leg housings, permanently mounted to the frame. The leg housings are mortised into the framework of the unit in such a way that the unit may be shipped in a shallow box and the leg assemblies affixed later by the consumer into the pre-mortised leg sockets.

The unit has four inner legs that can swing in or out of their leg socket and lock underneath the unit to hide them from view. Each leg can be released by removing the lock pin and then pivoted down and locked into the leg socket and held in position with a stainless steel pin. In this position, the unit is brought to a typical dining table height. At this height the unit can also be used as a massage table or a desk. The second and third decks may also be tilted and used in a slanted position creating a slanted surface to place work, photos, bulletin boards, etc.

There is a leg extension within each inner leg, capable of adding height to the table. Extended to the first hole and then locked into position by a pin, the table is now the correct height to be used as a countertop, work surface, or serving counter. Extended to the second hole, the height is such that the unit may now function as a bar or display table.

The unit is leveled by using the adjustable feet attached at the bottom of each leg extension to counter any uneven floor conditions

BRIEF DESCRIPTION OF THE SEVERAL VIEWS OF DRAWINGS

DETAILED DESCRIPTION OF THE PREFERRED EMBODIMENT

The convertible, integral, dining table, coffee table, serving table, desk, bed, bench and beach lounger utilizing a unique hinging system furniture apparatus generally comprises four flat deck sections, three of which are inclinable, one that tilts in two directions made possible by use of a hinge system developed specifically for this application and four legs that display both a pivoting action and an extendable action. The locking pins are the only feature of the apparatus that can be removed from the main structure. All other components are integral making the apparatus truly one-piece.

FIGS. 1, 2, 3, 5, and 9 show a first embodiment of the furniture apparatus in accordance with the present invention. The construction of the apparatus consists of several wood boards creating flat deck sections, a frame, legs and support structures. The unit is held together by a combination of wood screws, machine screws, nuts, washers, glue, hinges and pins. The material of the metal parts may be plated steel or alternatively and preferably stainless steel. The wood used is resistant to the elements and insects. Other materials may be used to construct all or parts of the apparatus.

Figure 1:
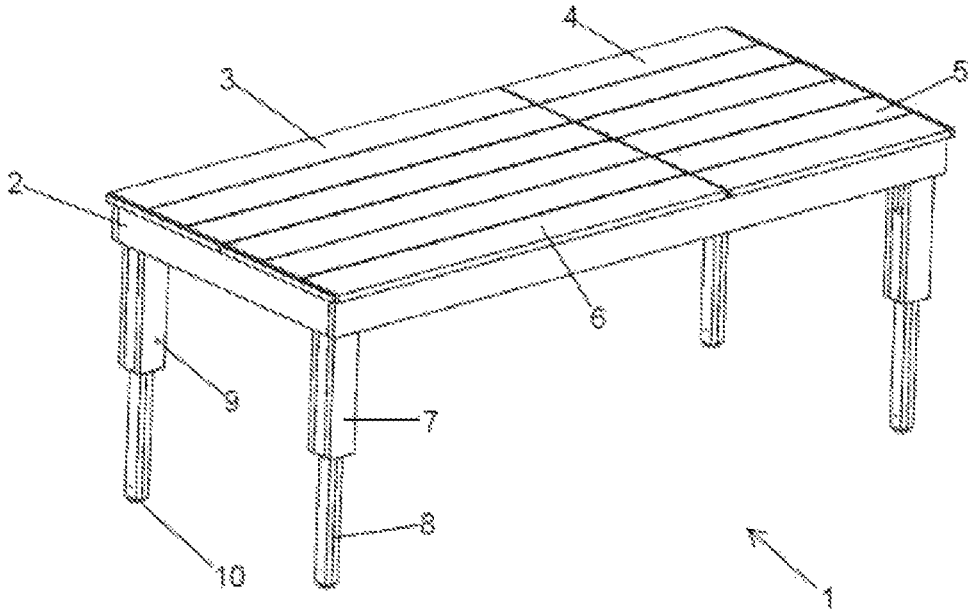
FIG. 1 is a perspective view of a first embodiment of the present invention as a table.
Figure 2:
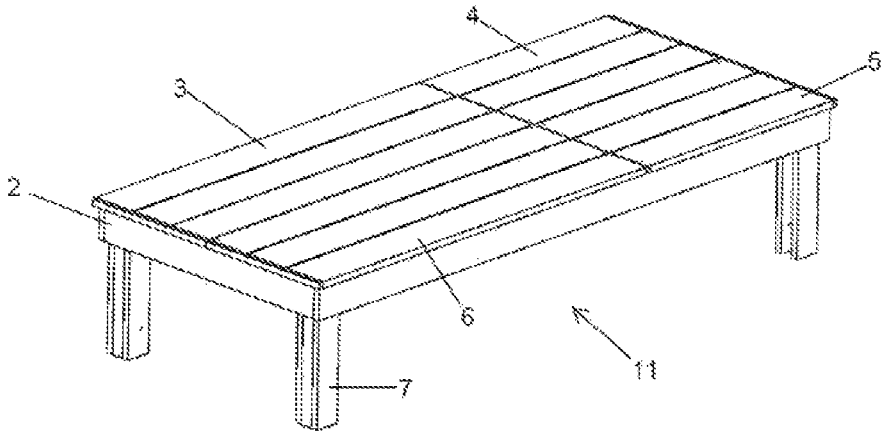
FIG. 2 is a perspective view of a first embodiment of the present invention as a coffee table.
Figure 3:
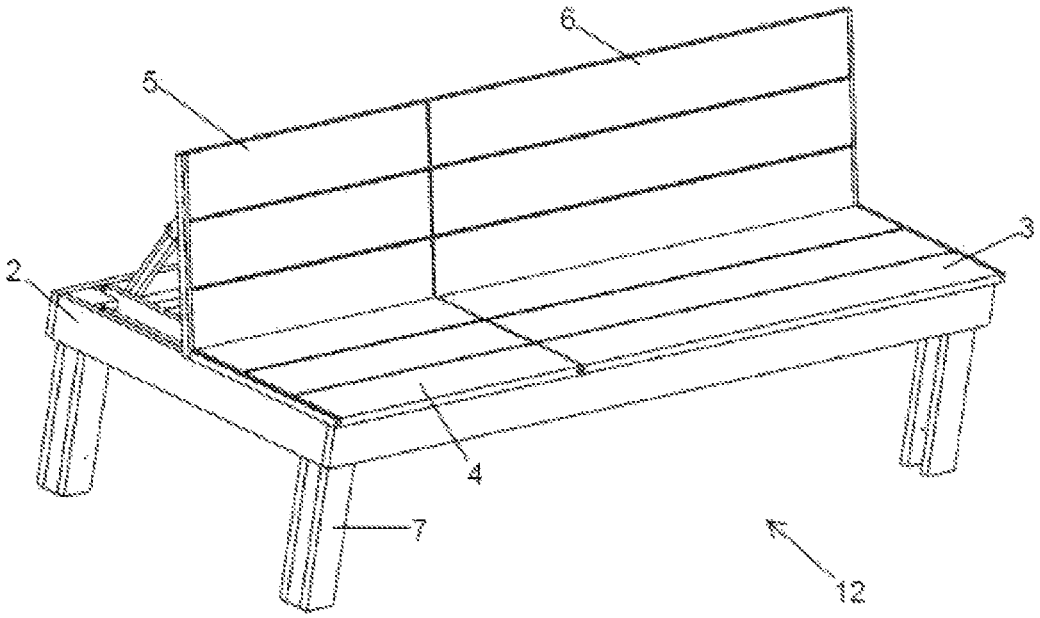
FIG. 3 is a perspective view of a first embodiment of the present invention as a bench.
Figure 5:
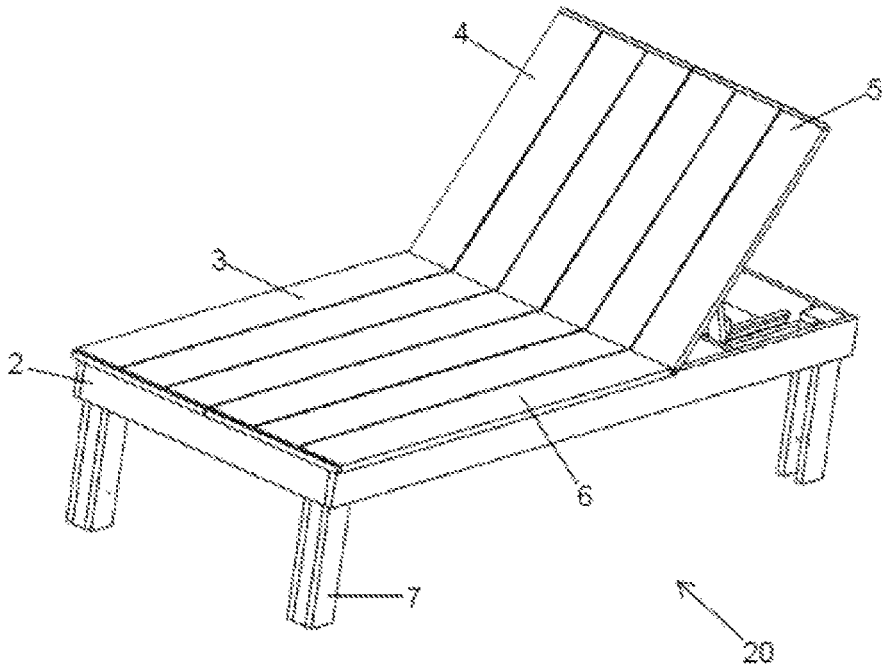
FIG. 5 is a perspective view of a first embodiment of the present invention as a beach lounger.
Figure 9:
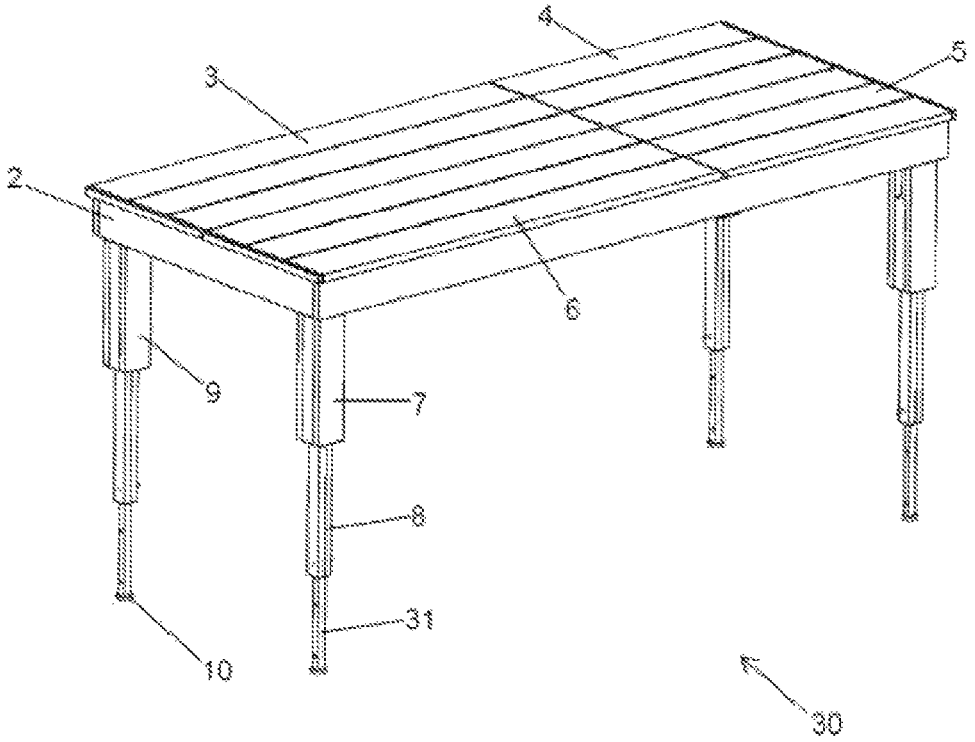
FIG. 9 is a perspective view of a first embodiment of the present invention as a serving table.

FIG. 1 shows the apparatus with the pivoting inner legs in a vertical position functioning as a table 1. The inner legs are locked into position by pins 9. FIG. 2 shows the apparatus with inner legs hidden in a horizontal position functioning as a coffee table or bed 11. FIG. 3 shows the apparatus with inner legs hidden in a horizontal position and decks 5 and 6 inclined functioning as a bench 12. FIG. 5 shows the apparatus with inner legs hidden in a horizontal position and decks 4 and 5 inclined functioning as a chaise lounge 20. FIG. 9 shows the apparatus with the pivoting inner legs in a vertical position and leg extensions 31 employed, functioning as a serving counter or bar 30. The inner legs are locked into position by pins 9.

Flat deck section 3 is permanently affixed to the frame 2 and does not incline. Decks 4, 5 and 6 incline to function as seat backs or a back rest. The leg housings 7 are U-shaped and allow for a pivoting inner leg 8 to swing towards the center and lock with pins 9 either in a vertical position, as shown in FIG. 1, or in a horizontal position, hidden as shown if FIG. 2. Levelers 10 located at the bottom of each leg allow for adjustment for an uneven floor.

Figure 4:
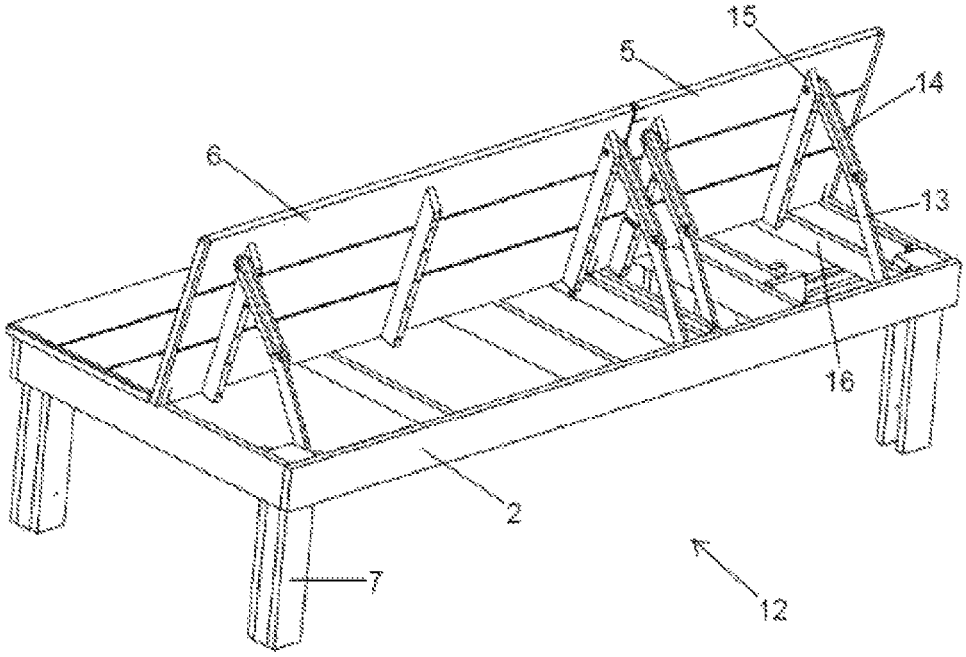
FIG. 4 is a perspective view of a first embodiment of the present invention as a bench looking from the rear.

Decks 5 and 6, when inclined to form seat backs for a bench as best shown in FIG. 4, are held in position by scissors type locking support arms 13 and 14. There are two support arms for each deck section. One end of support arm 13 is secured via an assembly of machine screws, washers and nuts to the frame 2. One end of support arm 14 is secured via an assembly of machine screws, washers and nuts to a cleat 15 on the underside of the decks 5 and 6. The support arms themselves are then connected via an assembly of machine screws, washers and nuts. All assembly connections fully pivot. When a deck section is raised, each support arm assembly unfolds and locks in position by a slight fingertip pressure applied outward at its center pivot. The support arms, which have pivoted ten degrees past straight are now locked in position and support the bench seat back whether the bench is sat upon by a person or people or unused. To lower the seat back decks, fingertip pressure is applied inward to the center pivot, creating a folding action in the support arms and the seat backs can be lowered by hand.

Figure 6:
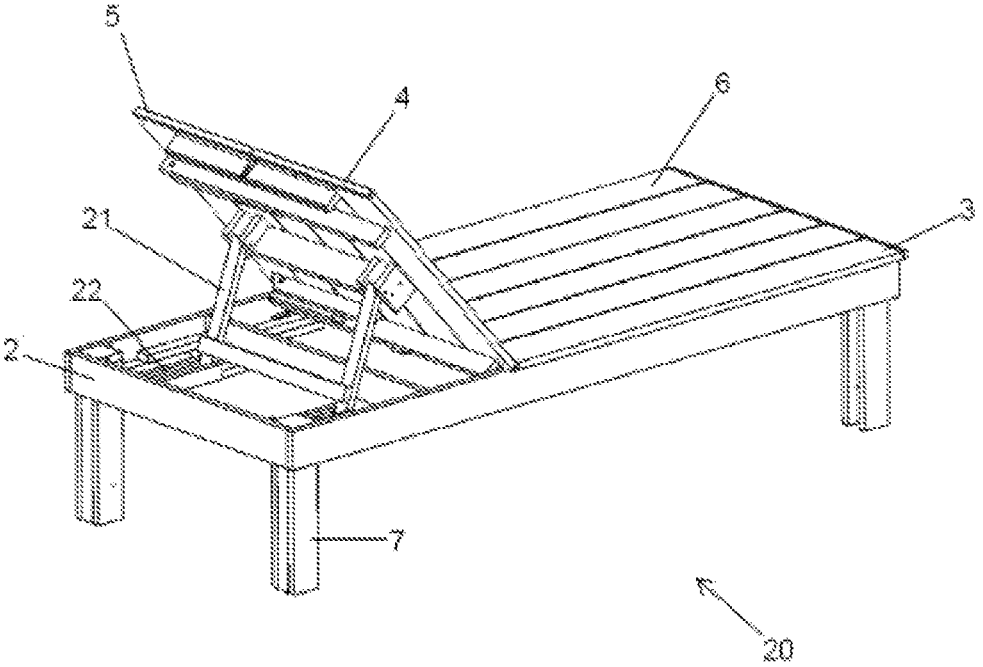
FIG. 6 is a perspective view of a first embodiment of the present invention as a beach lounger looking from the rear.
Figure 7A:
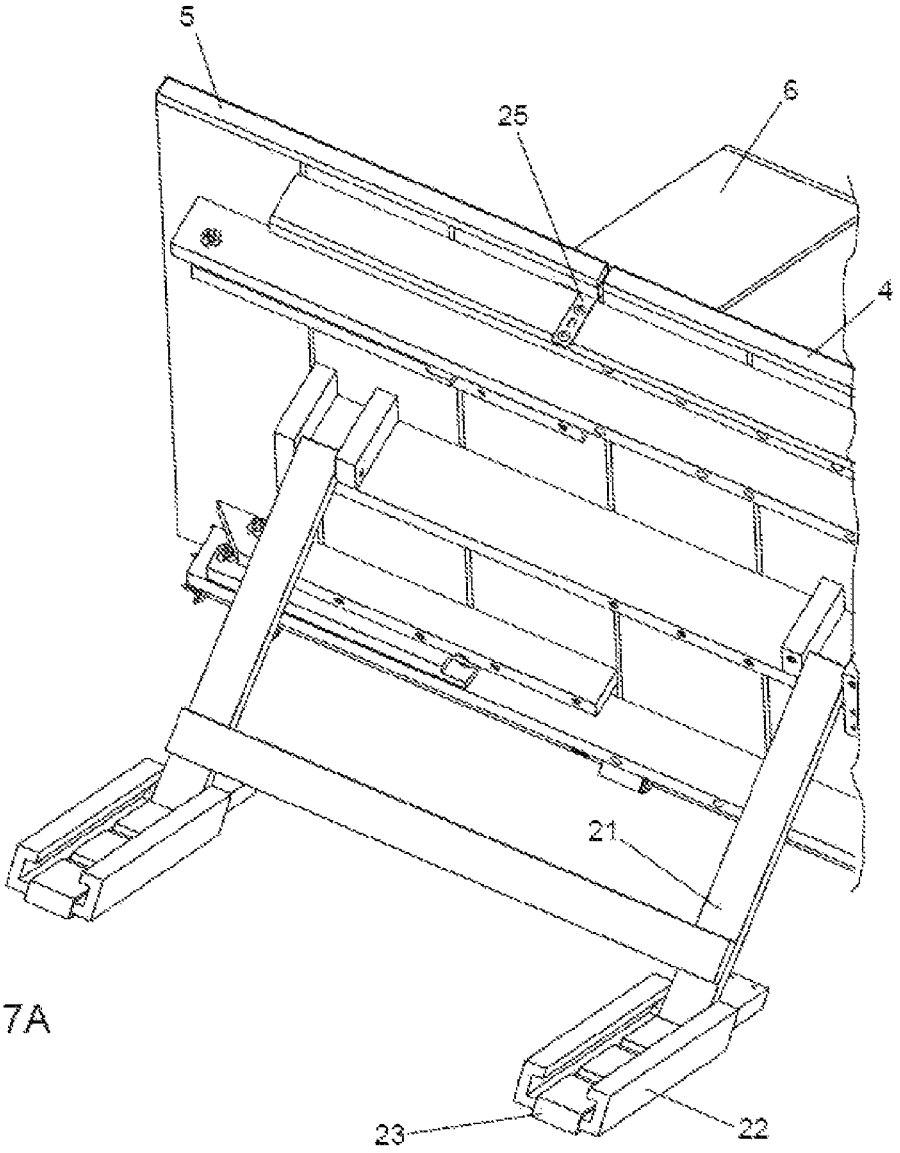
FIG. 7A is a close-up perspective view of a first embodiment of the present invention as a beach lounger looking from the rear.

Decks 4 and 5, when inclined simultaneously to form a back rest for a chaise or beach lounger as best shown in FIGS. 6 and 7A are held in position by a track guided swinging support arm assembly 21. The swinging support arm assembly 21 is attached at its upper end to the underside of deck 4 and supports but is not attached to deck 5. Deck 5 is supported but must remain unattached to allow it to pivot when used as a seat back for the bench configuration 12. The swinging support arm assembly 21 is guided at its lower end to dual support tracks 22 which have a rail 23 with evenly spaced detents to allow the back rest to incline and stay in position at several different angles. The swinging support arm assembly 21 lower ends have horizontal pins on each end that ride within the support track 22. This provides stability of the swinging arm assembly 21 while ensuring the back rest is not over-inclined causing undue stress on the hinge assembly, shown in FIG. 8A.

Figure 8A:
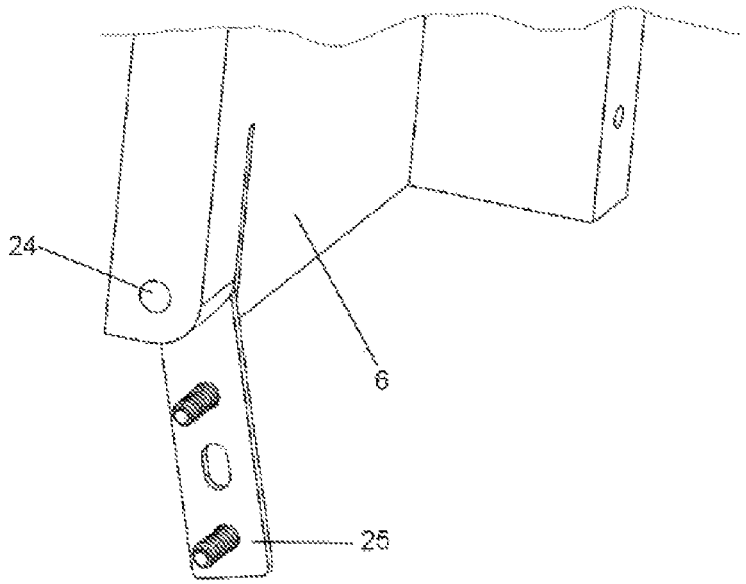
FIG. 8A is a close-up perspective view of a first embodiment of the present invention of the hinge assembly.

The hinge assembly shown in FIG. 8A was developed specifically to allow the present invention to hinge in two directions. The hinge assembly is comprised of a metal hinge 25, a pin 24 and two screws. There is a two-fold, unique aspect to the hinging system:

One: The slot the hinge 25 fits into is blind, or cut only from one side of a deck board 4, 5, and 6, not all the way through. This means from the visible top side of the decks, no slot or hinge is seen. In essence, the hinge 25 is invisible or hidden to the user.

Two: Decks 4, 5 and 6 attach with the hinges 25 to either the frame 2, a leg housing or a floating cantilever 16. There are two floating cantilevers 16 located under decks 4 and 5 which give a place to anchor the support arm 13 but being unfixed to the frame 2, allows the decks 4 and 5 to also tilt as a chaise lounge back rest. Thus, a double-acting hinged deck that hinges both front-to-back and left-to-right.

The height of the deck surfaces may be further increased by extending the four leg extensions 31 by various yet equal amounts and securing their position by inserting a pin through the extension 31 and the leg housing 7.

Thus, it is evident that a set of flat decks can be uniquely hinged to a fixed frame and floating cantilevers allowing for hinging in two directions, while the hinges remain hidden from view to the user. By adjusting the height of the decks, the apparatus is suitable for sitting, reclining or lying upon, dining or writing upon or displaying or serving upon. Accordingly, while the present invention has been shown and described with reference to the aforementioned preferred embodiment, it will be apparent to those skilled in the art that changes in form, connection and detail may be made therein without departing from the spirit and scope of the invention as defined in the appended claims:

What is claimed is:

1. A furniture apparatus including a convertible, integrated table, coffee table, serving table, desk, bed, bench and beach lounger comprising:

a single, rectangular frame, said frame having a width and a depth, the width being longer in length than the depth and having four corners, said frame having multiple leg assemblies;

said leg assemblies located and secured at the four corners of said frame to support said frame on a floor;

a first flat deck section, mounted to said frame in a fixed, stationary manner;

a second, third, and fourth flat deck section, said first deck section and said second deck section being equal in length and longer than said third and said fourth deck sections, said second, third, and fourth flat deck sections being pivotally connected to said rectangular frame wherein the second, third, and fourth flat deck sections are individually or conjointly configured to lie flat and be selectively pivotally adjustable to form any one of said table, coffee table, serving table, desk, bed, bench, and beach lounger; and said second and third flat deck sections having a pivotal connection to the frame, said second and third flat deck sections being individually or conjointly pivotally connected along a first axis that extends along the width of the frame, with said second and third flat deck sections being pivotally adjustable with respect to said first and fourth flat deck sections to form said bench with a first upwardly extending back rest for supporting the back of a person sitting on the bench;

said third and fourth flat deck sections having a pivotal connection to the frame, said third and fourth flat deck sections being configured to pivot together along a second axis that extends along a depth of the frame, said second axis being perpendicular to said first axis along which said second and third flat deck sections are pivotally adjusted, said third and fourth flat deck sections being angularly adjusted about the second axis to form said beach lounger with a second selectively angularly adjustable back rest for supporting the back of a person sitting or lying on the beach lounger;

a hinge, wherein the hinge comprises a flat metal stamping and a pin, said stamping has a first end and a second end; said hinge configured to form the pivotal connections between said second, third and fourth deck sections and said frame; and said leg assemblies being both pivotably attached to the frame and extendable to selectively adjust the furniture apparatus to a desired height for any one of a table, coffee table, serving table, desk, bed, bench and beach lounger.

2. The furniture apparatus as set forth in claim 1 wherein the hinge comprises 300 series stainless steel.

3. The furniture apparatus as set forth in claim 1 wherein the pivotal connections are formed with the first end of the hinge being secured to said frame by screws and the second end of the hinge is secured within a slot in said second, third and fourth flat deck sections; and a metal pin driven into the second end of said hinge and into a hole in said second, third and fourth flat deck sections.

4. The furniture apparatus as set forth in claim 1 wherein all said flat deck sections and said leg assemblies are adjustable to a proper height for allowing apparatus to be used as a coffee table or bed.

5. The furniture apparatus as set forth in claim 4 wherein said second or third deck sections, but not both simultaneously, pivot about said hinges allowing apparatus to be used as a bench with an integral end table.

6. The furniture apparatus as set forth in claim 1 wherein said pivoting leg assemblies are configured to rotate ninety degrees from horizontal, each leg assembly secured to the frame by a metal pin, allowing all said flat deck sections to be adjusted to a proper height for allowing said apparatus to be used as a table or desk.

7. The furniture apparatus set forth in claim 1 wherein said pivotable leg assemblies are each comprised of a leg housing, a pivoting inner leg, and an extendable leg with footing pad and leveler.

8. The furniture apparatus as set forth in claim 7 wherein said extendable legs are extended from the inner leg by equal amounts, each secured with a metal pin, allowing all said flat deck sections to be adjustable to a proper height for allowing said apparatus to be used as a serving table.

9. The furniture apparatus set forth in claim 1 wherein said second and third flat deck sections, when tilted as back rests, are secured in position by a series of two-piece self-locking support arms that function via scissor action to unfold when pivoting said second and third flat deck sections and lock in place to hold said second and third flat deck sections at the proper back rest angle.

10. The furniture apparatus as set forth in claim 1 wherein said third and fourth flat deck sections, when tilted as back rest, are secured in position by a support arm assembly which locks in place in uniformly spaced detents located on said frame, allowing said back rest to adjust to several angles.

* * * * *